United States Patent [19]

Schneider

[11] 4,285,501

[45] Aug. 25, 1981

[54] APPARATUS FOR RETAINING GUIDE PULLEYS FOR LOAD CABLES OF A BUILDING FRONT CABLE LIFT IN A HOUSING STATIONARILY ARRANGED AT THE TOP OF A BUILDING

[75] Inventor: Erich Schneider, Emmelshausen, Fed. Rep. of Germany

[73] Assignee: Kombi-Lift Montage- und Handelsgesellschaft mbH, Solingen, Fed. Rep. of Germany

[21] Appl. No.: 132,573

[22] Filed: Mar. 21, 1980

[30] Foreign Application Priority Data

Mar. 21, 1979 [DE] Fed. Rep. of Germany ..... 2911029

[51] Int. Cl.[3] ..... B66D 3/06

[52] U.S. Cl. ..... 254/394; 52/37; 182/70; 254/134.3 R; 254/410; 254/415

[58] Field of Search ..... 254/410, 409, 415, 413, 254/393, 394, 288, 134.3 R, 134.3 PC; 182/76, 74, 4, 70; 52/37, 64, 27, 29

[56] References Cited

U.S. PATENT DOCUMENTS

| | | | |
|---|---|---|---|
| 996,803 | 7/1911 | Schnoor | 254/415 |
| 1,398,855 | 11/1921 | Hale | 254/415 |
| 2,078,146 | 4/1937 | LeBlanc | 182/76 |
| 2,709,030 | 5/1955 | Kroman et al. | 182/76 |

*Primary Examiner*—Billy S. Taylor

*Attorney, Agent, or Firm*—John C. Smith, Jr.

[57] ABSTRACT

An apparatus for retaining guide pulleys for load cables of a building front cable lift in a housing stationarily arranged at the top of a building, from which housing said guide pulleys are outwardly pivotable from ground. In the housing which is open at its face there are supported two beams which are outwardly pivotable horizontally and carry the guide pulleys for the load cables. The beams are retained releasably by means of an interlocking device arranged in the interior of the housing. The interlocking device is releasable by means of auxiliary cables guided on the guide pulleys, said auxiliary cables depending from an edge cutout in the base of said housing.

3 Claims, 5 Drawing Figures

1
2
3
4
5
6
7
8
9
10
11
12
II
IV

APPARATUS FOR RETAINING GUIDE PULLEYS FOR LOAD CABLES OF A BUILDING FRONT CABLE LIFT IN A HOUSING STATIONARILY ARRANGED AT THE TOP OF A BUILDING

BACKGROUND OF THE INVENTION

This invention relates to an apparatus for retaining guide pulleys for load cables of a building front cable lift in a housing stationarily arranged at the top of a building, from which housing the guide pulleys are outwardly pivotable from ground.

Such apparatus find application in particular for building front cable lifts for rescuing for instance people in fire emergency, in order to protect the guide pulleys constituting fixed components of the building in their housing against weather effects and in order to thereby insure that the guide pulleys are ready for use in case of an emergency. In a conventional apparatus, cable drums are supported at the internal sides of two wings outwardly pivotable horizontally, on which drums the load cables are wound up. The load cables are provided with weights at their one ends. The wings are locked in the lock position by a latch. Said latch is able to be drawn out of its lock from ground by means of a remote control cable, the result being that the wings with the cable drums are pivoted into the open position via spring-loaded pivot levers and are retained in this position. Furthermore, the load cables unwind in the open position of the wings subject to the action of the weights from the cable drums to ground. Such an apparatus in which the load cables are wound up prior to operating the lift is not able to be employed for a building front cable lift provided for high buildings alone in view of the required size of the cable winding capacity of the cable drums. Furthermore, such an apparatus is relatively complicated as a result of the spring-loaded pivot levers, it thereby not being able to be precluded with the degree of safety required for rescue cable lifts that as a result of rusting or contamination the outward pivoting of the guide pulleys from the housing and thus the use of the lift is uncertain.

SUMMARY OF THE INVENTION

It is, therefore, the object of the present invention to improve the apparatus of the species referred to initially in such a way that with one and the same means from ground the guide pulleys are able to be reliably outwardly pivoted from the housing and the load cables located at the lift basket are able to be drawn via the guide pulleys upwardly and back to ground.

To attain this object the present invention provides an apparatus for retaining guide pulleys for load cables of a building front cable lift in a housing stationarily arranged at the top of a building, from which housing said guide pulleys are outwardly pivotable from ground, said apparatus comprising an elongate housing having a base, a rear wall, a top wall, end walls and an open face; two beams pivotally mounted in the housing; guide pulleys rotatably mounted in the beams and arranged to guide load cables; means for pivoting the beams along with the guide pulleys outwardly horizontally from the housing; an interlocking device arranged in the interior of the housing and releaseable by means of auxillary cables guided on the guide pulleys, said auxillary cables passing through and depending from an edge cutout in the base of the housing.

It is achieved in an advantageous manner with the apparatus of this invention that both the releasing of the interlocking device and the outward pivoting of the beams with the guide pulleys from the housing are effected forcedly by means of the auxiliary cables. As a result of the forced outward pivoting of the guide pulleys by means of the auxiliary cables, it is insured that even in the event of rusting or contamination the guide pulleys and thus the lift are reliably and rushly ready for use. Furthermore, by means of the auxiliary cables after an outward pivoting of the guide pulleys the load cables connected to the lift basket are drawn over the guide pulleys in that the auxiliary cables are shackled to the load cables with their ends and are drawn by pulling the other ends over the guide pulleys to ground. The auxiliary cables which thereafter are no longer needed are then released from the load cables, and these are connected in a conventional fashion to drive discs. After termination of use of the lift, the auxiliary cables are again shackled to the load cables released from the lift basket and drawn over the guide pulleys again by means of the load cables, the load cables thereafter being released from the auxiliary cables.

In an advantageous embodiment of the invention, the interlocking device may comprise a pin mounted vertically shiftable in the housing, said pin carrying a cable at its lower end, which cable is connected at its ends to the auxiliary cables through the intermediary of members provided with predetermined fracture points secured to the one parts of the auxiliary cables, said pin being provided at its upper end with a firmly arranged head portion by means of which the pin is in engagement with hooks firmly arranged at the beams subject to the pressure loading of a helical spring pushed onto it.

By simply pulling the auxiliary cables, the interlocking device is released, thereafter the beams with the guide pulleys being able to be outwardly pivoted from the housing by means of the auxiliary cables after releasing the cable connecting the auxiliary cables to the pin from the auxiliary cables.

An advantageous development of the apparatus according to the invention is that the downwardly depending portions of the auxiliary cables may be held together by rings provided with a predetermined fracture point. It is thereby prevented to advantage that when outwardly pivoting the beams from the housing by means of the auxiliary cables latter slip out of the guide pulleys.

BRIEF DESCRIPTION OF THE DRAWINGS

An embodiment of the invention will now be described by way of example and with reference to the accompanying drawings, in which.

DESCRIPTION OF THE PREFERRED EMBODIMENT

Figures 1, 2:
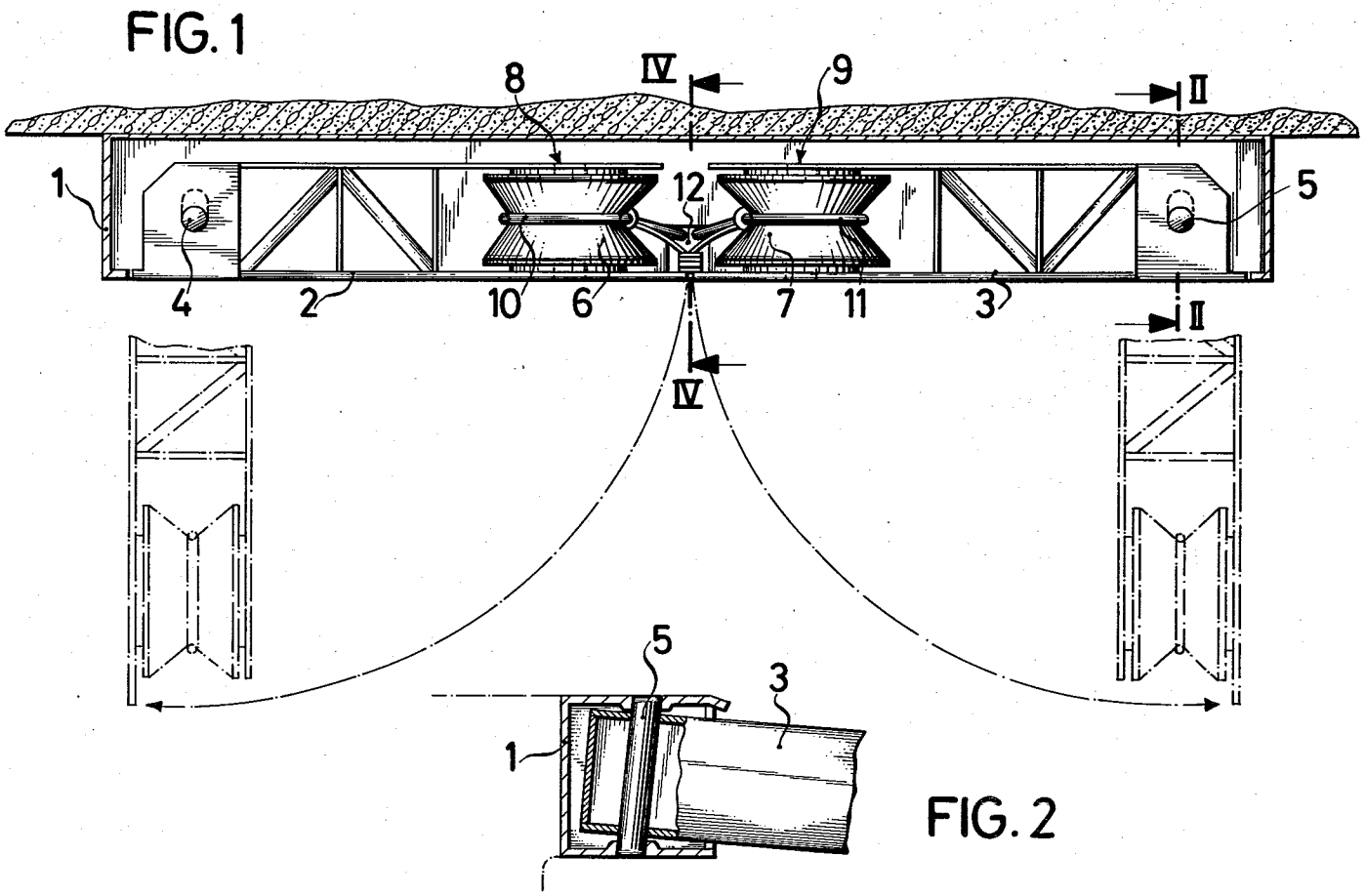
FIG. 1 is a plan view, partially in section, of an apparatus according to the invention.
FIG. 2 is a sectional view taken along line II—II of FIG. 1.

FIGS. 1 and 2 show an elongate, box-shaped housing 1 generally mounted at the level of the roof of a building, said housing being open at its face. In the housing 1, there are arranged juxtaposed two rectangular beams 2 and 3 which are open at their ends opposing each other. At their outer ends, the beams 2 and 3 are pivotally mounted on pins 4 and 5, said pins being arranged vertically or substantially vertically in the walling of the housing 1. In FIGS. 1 and 2 the pins are shown somewhat inclined in the direction toward the open face of the housing 1. Guide pulleys 6 and 7 are arranged in the beams 2 and 3 at the inner ends of the beams, said pulleys 6 and 7 being supported rotatably on pins 8 and 9 provided in the walling of the beams 2 and 3. Two auxiliary cables 10 and 11 are passed over the guide pulleys 6 and 7. Said cables are passed with their free ends through an edge cutout 12 in the base 13 (FIG. 3) of the housing 1. They depend downwardly so far that they are able to be reached from ground. The auxiliary cables 10 and 11 are usually, i.e. when the lift is not in use, secured easily releaseable to the front of the building by means of brackets 14 which are arranged at strips 15.

Figure 3:
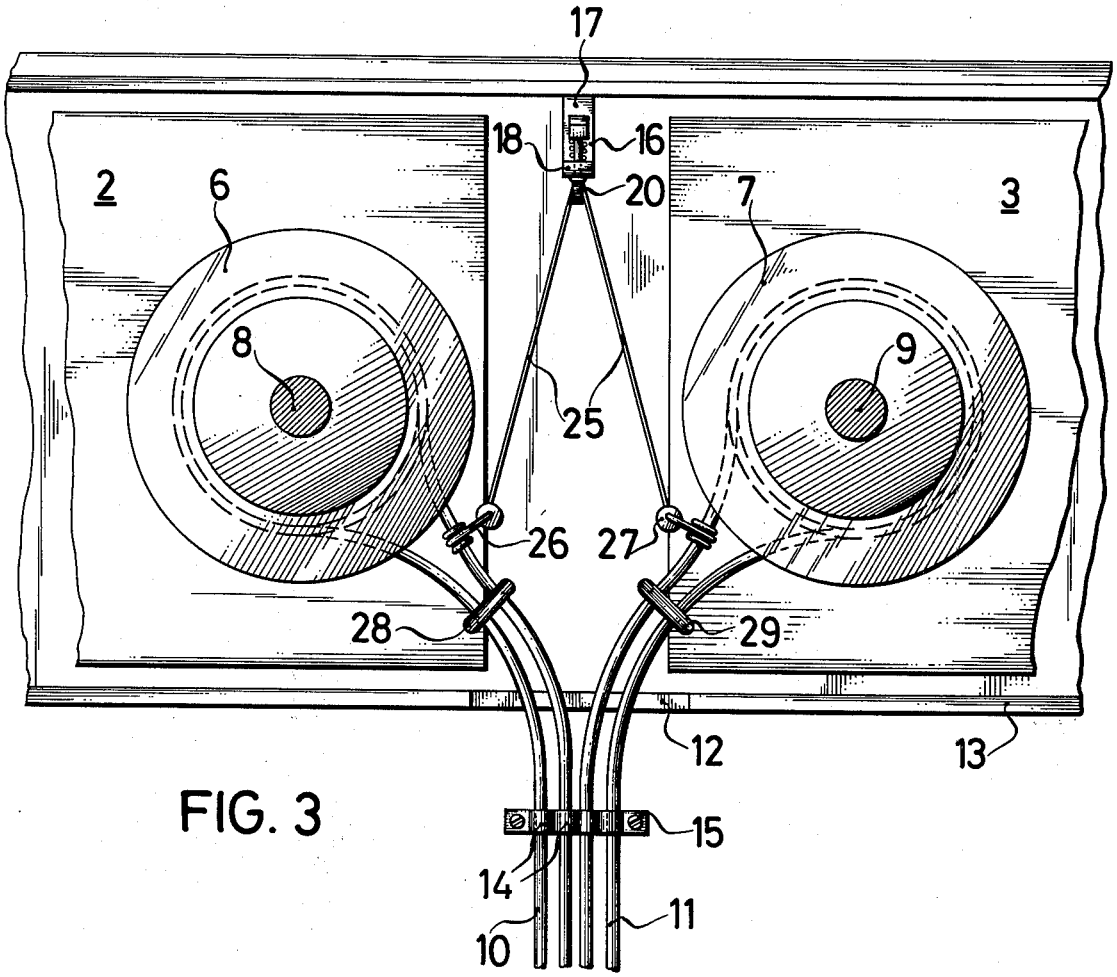
FIG. 3 is a fragmentary front elevational view, on a larger scale in relationship to FIG. 1, of the apparatus.
Figure 4:
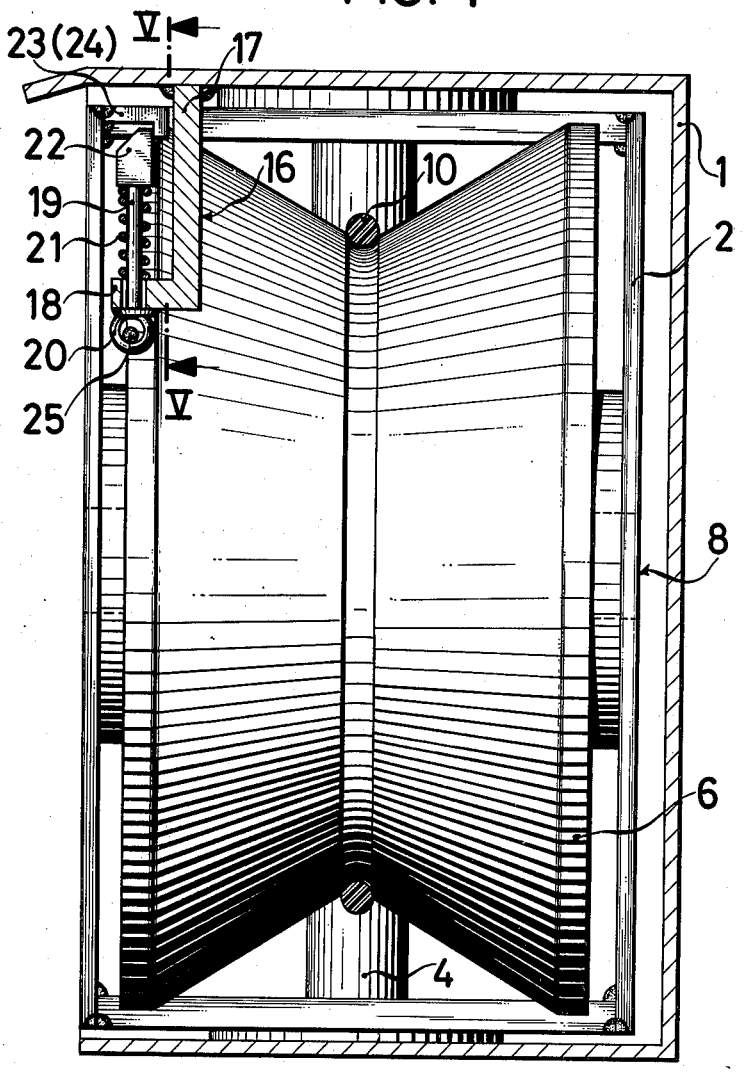
FIG. 4 is a sectional view, on an enlarged scale, taken along line IV—IV of FIG. 1.
Figure 5:
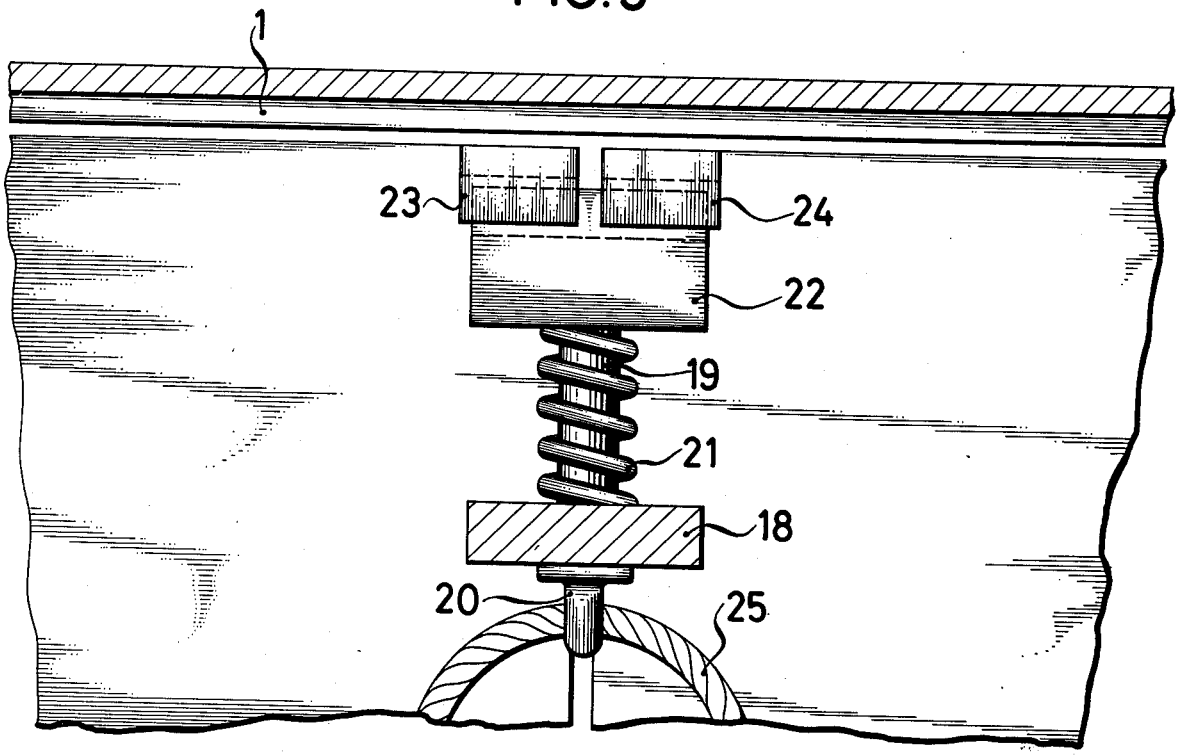
FIG. 5 is a structural detail.

Referring to FIGS. 3 and 4, to the top side of the housing 1, internally there is firmly secured an angular arm 16 with the free end of one of its limbs 17, a pin 19 being vertically shiftably supported in the other limb 18 thereof. The pin 19 is provided at its lower end with which it projects beyond the limb 18 with a ring 20. A prestressed helical compression spring 21 is pushed onto the pin 19. Said spring 21 rests with its one end on the limb 18 of the angular arm 16 and with its other end on a head portion 22 which is firmly secured to the upper end of the pin 19. The beams 2 and 3 are provided at their ends remote from the fulcrums with hooks 23 and 24 behind which the head portion 22 of the pin 19 engages subject to the thrust of the helical compression spring 21. The beams 2 and 3 in this condition are held in a horizontal position relative to one another with the guide pulleys 6 and 7 in the housing 1. A cable 25 passes through the ring 20 arranged at the pin 19. Said cable is hung with its ends into annular members 26 and 27 provided with predetermined fracture points, which members are firmly connected to the one portions of the auxiliary cables 10 and 11. The downwardly depending portions of the auxiliary cables 10 and 11 are held together by rings 28 and 29 likewise provided with a predetermined fracture point. When the beams 2 and 3 have been outwardly pivoted, the rings 28 and 29 may readily be torn open by means of the auxiliary cables 10 and 11 at the predetermined fracture points.

When exerting a pulling action upon the auxiliary cables 10 and 11, the pin 19 is drawn in counteraction to the helical compression spring 21 by means of the cable 25 connecting the auxiliary cables 10 and 11 and the pin 19 so far that the head portion 22 of the pin 19 is disengaged from the hooks 23 and 24 of the beams 2 and 3 and the beams 2 and 3 are released. When further pulling the auxiliary cables 10 and 11, the beams 2 and 3 are outwardly pivoted from the housing 1 along with the guide pulleys 6 and 7. The members 26 and 27 provided with the predetermined fracture points and secured to the one portions of the auxiliary cables 10 and 11 fracture at the fracture points, the cable 25 secured to the pin 19 thereby being released from the auxiliary cables 10 and 11. The pin 19 thereafter as a result of the previously stressed and now unstressing helical compression spring 21 returns into the starting position. The auxiliary cables 10 and 11 are thereafter shackled with their one ends to the load cables located at the lift basket, said load cables being drawn by pulling at the other ends of the auxiliary cables 10 and 11 over the guide pulleys 6 and 7. Thereafter, the auxiliary cables 10 and 11 are released from the load cables, and the load cables are for instance connected to drive discs, the lift then being ready for operation.

The invention may be embodied in other specific forms without departing from the spirit or essential characteristics thereof. The embodiment is therefore to be considered in all respects as illustrative and not restrictive.

What is claimed is:

1. An apparatus for retaining guide pulleys for load cables of a building front cable lift in a housing stationarily arranged at the top of a building, from which housing said guide pulleys are outwardly pivotable from ground, said apparatus comprising (a) an elongate housing (1) having a base (13), a rear wall, a top wall, end walls and an open face;

(b) two beams (2,3) pivotally mounted in the housing;

(c) guide pulleys (6,7) rotatably mounted in the beams and arranged to guide load cables;

(d) means for pivoting the beams along with the guide pulleys (6,7) outwardly horizontally from the housing;

(e) an interlocking device arranged in the interior of the housing and releasable by means of auxiliary cables guided on the guide pulleys, said auxiliary cables passing through and depending from an edge cutout (12) in the base (13) of the housing (1).

2. An apparatus as set forth in claim 1, wherein said interlocking device comprises a pin (19) mounted vertically shiftable in said housing, said pin carrying a cable (25) at its lower end, which cable is connected at its ends to the auxiliary cables (10,11) through the intermediary of members provided with predetermined fracture points secured to the one parts of the auxiliary cables, said pin (19) being provided at its upper end with a firmly arranged head portion (22) by means of which the pin is in engagement with hooks (23,24) firmly arranged at the beams (2,3) subject to the pressure loading of a helical spring (21) pushed onto it.

3. An apparatus as set forth in claim 1, wherein the downwardly depending portions of said auxiliary cables (10,11) are held together by means of rings (28,29) provided with a predetermined fracture point.

* * * * *